United States Patent [19]

Kiuchi

[11] Patent Number: 4,627,231

[45] Date of Patent: Dec. 9, 1986

[54] MESH BAND

[76] Inventor: Manabu Kiuchi, 2-12-21, Shinjyuku, Zushi-Shi, Kanagawa-Ken, Japan

[21] Appl. No.: 669,190

[22] Filed: Nov. 7, 1984

[30] Foreign Application Priority Data

Mar. 1, 1984 [JP] Japan ..... 59-039283

[51] Int. Cl.[4] ..... F16G 13/00

[52] U.S. Cl. ..... 59/80; 59/79.1; 63/4

[58] Field of Search ..... 59/79.1, 79.2, 80, 20, 59/78, 901, 79.3, 83; D11/18, 19, 20; 63/4, 5 R, 5 A, 6; 245/6

[56] References Cited

U.S. PATENT DOCUMENTS

| | | | |
|---|---|---|---|
| 2,135,333 | 11/1938 | Guba | 245/6 |
| 2,430,776 | 11/1947 | Miller | 59/79.3 |
| 2,451,749 | 10/1948 | Kreisler | 63/4 |
| 2,451,780 | 10/1948 | Siska | 63/4 |
| 4,089,161 | 5/1978 | Aoki | 59/80 |
| 4,490,970 | 1/1985 | Curl | 59/79.1 |

FOREIGN PATENT DOCUMENTS

| | | | |
|---|---|---|---|
| 2500980 | 7/1976 | Fed. Rep. of Germany | 59/80 |
| 1264684 | 5/1961 | France | 59/80 |

*Primary Examiner*—Francis S. Husar
*Assistant Examiner*—David B. Jones
*Attorney, Agent, or Firm*—Jordan and Hamburg

[57] ABSTRACT

A mesh band includes a plurality of juxtaposed helical members, each of the helical members having end faces, and connecting pin members for connecting the helical members to form a mesh band, each of the pin members having a head and at least one pin body, the pin bodies being disposed within the helical members, the heads of the pin members being disposed juxtaposed to the end faces of the helical members, the pin members thereby connecting the helical members to form a unitary mesh band while the heads cover the ends of the helical coils as a protection when the mesh band is used.

16 Claims, 14 Drawing Figures

MESH BAND

BACKGROUND OF THE INVENTION

The present invention relates to a mesh band which comprises helical members and pin members and which might be used chiefly in the fields of a bracelet and the bracelet of a wrist watch.

Helical members are classified as to the direction of wind into left-handed or S-twist helical members 1 as shown in FIG. 1, and right-handed or Z-twist helical members 2 as shown in FIG. 2. A mesh band 3 as shown in FIGS. 3, 4 is known which comprises a row of parallel, helical members of the same direction of wind, for example, left-handed helical members 1 fitted into one another, or passing through one another. Another mesh band 6 or 7 as shown in FIGS. 5, 6, 7 or in FIG. 8 is also known which is manufactured by causing a row of parallel, alternate helical members of different directions of wind, for example, parallel, alternate left-handed and right-handed helical members 1, 2 to engage with one another, and then by inserting a connecting rod across the length of each of the columns of the portions 4 at which such engagements take place, to connect the helical members 1, 2 to one another.

In any of these mesh bands 3, 6, 7 fabricated according to the prior art, the cut ends 8 and/or 9 of the helical members 1 and/or 2 appear on both lateral faces of the mesh band, as shown in the schematic perspective views of FIG. 4 and/or FIG. 6. Therefore any one of the mesh bands 3, 6, 7 has a drawback that, when it is worn about the wrist, the cuff of a sleeve of a wearer's apparel catches on the cut ends 8 and/or 9 of the helical members 1 and/or 2. They possess another drawback in that it is difficult to expect absolute safety from them since the cut ends 8 and/or 9 can damage other objects and inflict bodily injury on the wearer himself or herself and on other persons.

Various attempts have been proposed to elminate the above-mentioned drawbacks; for example, either the cut ends 8 and/or 9 are individually brazed or pushed into the inside, or the lateral faces of the mesh band 3, 6 or 7 are hammered or spread out in order to form flat ones. However, these operations require intricate process steps and cost a great deal. Furthermore, such finished goods themselves do not look nice and are of no value as articles of commerce. Especially in the case where helical members are made of a noble metal, in the prior art a process of individually brazing the cut ends requires an extremely large number of man-hours. Another attempt has been proposed in which an unfinished mesh band is folded across two straight lines which pass through their respective points at a perpendicular distance of approximately ¼ of the width of the unfinished mesh band from both edges thereof and which are parallel to the longitudinal center line, in such a way that the both edges are brought to the center line on the wrong side, and then the unfinished mesh band thus folded is sewn at the middle. In this case, the mesh band has a drawback in that its thickness will become larger unless a smaller diameter is employed as the diameter of a piece of wire out of which a helical member is formed.

SUMMARY OF THE INVENTION

The long standing need for a mesh band free from the drawbacks or problems as recited above has been met by the mesh band of the invention which comprises: a row of parallel, helical members intermeshing with one another or fitted into one another; and a multiplicity of pairs of connecting pin members, each connecting pin member having at least one pin body and a head. The pin bodies of the connecting pin members are inserted from the end faces of the helical members thereinto in such a way that the connecting pin members of each pair are diametrically opposed to each other with relation to the longitudinal centerline of the mesh band. The pin bodies thus inserted connected the helical members to one another as well as impart flexibility to the mesh band. The heads of the connecting pin members cover the cut ends or end faces of the helical members to make the whole of the lateral faces of the mesh band smooth.

Figure 1:
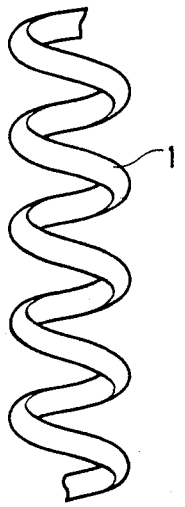
FIG. 1 is a front view of a left-handed helical member.
Figure 2:
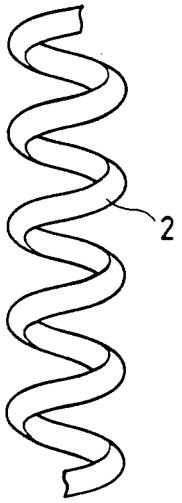
FIG. 2 is a front view of a right-handed helical member.

1 Left-handed helical member
2 Right-handed helical member
8, 9 Cut end
10, 11, 12, 13 Mesh band
14 Connecting pin member
15 End face
16 Pin body
17 Head

DESCRIPTION OF THE PREFERRED EMBODIMENTS

Referring now to the accompanying drawings, the invention will now be explained with respect to the embodiments shown in the drawing.

Figure 3:
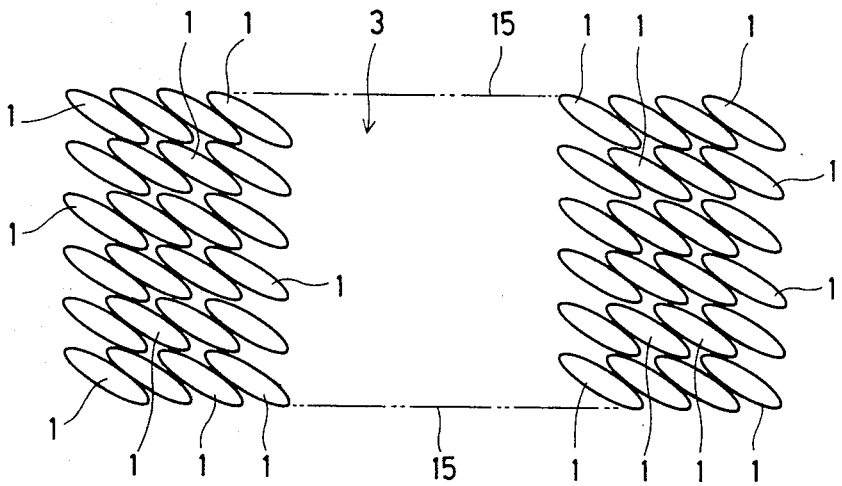
FIG. 3 is a schematic plan view of a conventional mesh band which comprises a row of parallel, helical members of the same wind direction fitted into one another.
Figure 4:
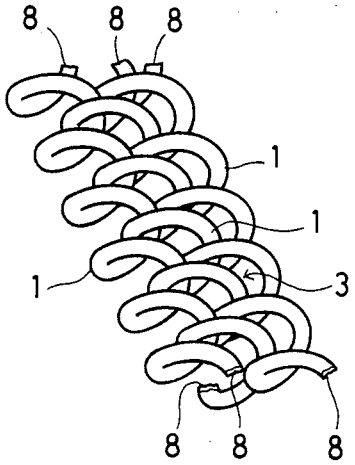
FIG. 4 is a perspective view of the conventional mesh band of FIG. 3.
Figure 9:
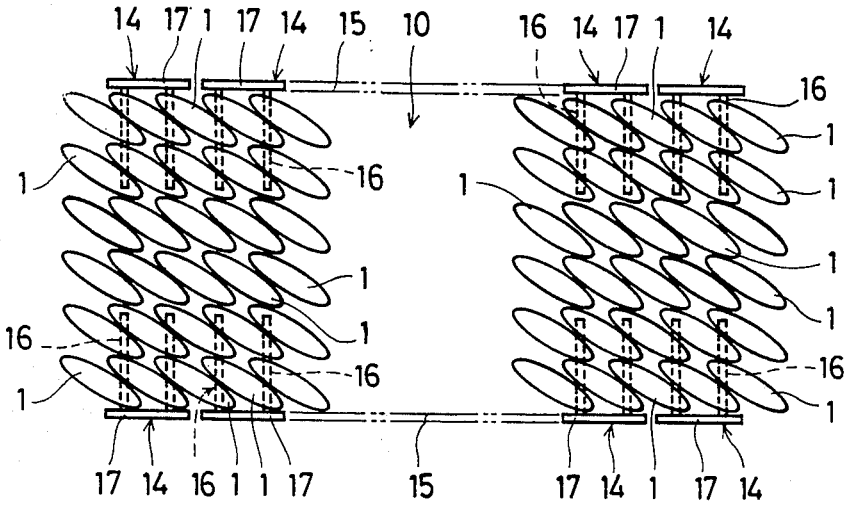
FIG. 9 is a schematic plan view of an embodiment according to the invention which is roughly the same as the conventional mesh band of FIG. 3 in the arrangement of helical members.
Figure 10:
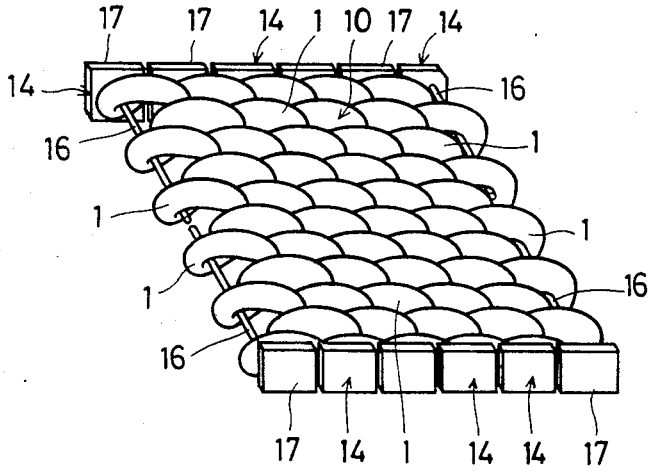
FIG. 10 is a perspective view of the embodiment of FIG. 9.

A mesh band embodying the invention may be seen in FIG. 9 and comprises a band-like object or a stripe consisting of a row of parallel, helical members of the same direction of wind, for example, parallel, left-handed helical members 1 fitted into one another and having two end faces 15; and a multiplicity of pairs of connecting pin members 14, each having two pin bodies 16 and a head 17 integral therewith. The pin bodies 16 of the connecting pin members 14 are inserted from the end faces 15 of the helical members 1 thereinto in such a way that the connecting pin members 14 of each pair are diametrically opposed to each other with relation to the longitudinal centerline of the band-like object. The pin bodies 16 thus inserted connect the helical members 1 to one another. The coils of the helical members 1 are pressed to the inserted pin bodies 16 so as to be rigidly fixed thereto. FIG. 10 is a perspective view of the embodiment of FIG. 9. The embodiment is roughly the same as a conventional mesh band of FIG. 3 in the arrangement of helical members. Since the parallel, left-handed helical members 1 shown in FIG. 3 are fitted into one another, a band-like object or a strip can be made out of only the helical members of the same direction of wind without the insertion of connecting rods 5 from the end faces 15 into the helical members 1. However, a mesh band embodying the invention is manufactured by the steps of: slitting a row of parallel, left-handed helical members 1 of multiple length fitted into one another, into multiple band-like objects or strips of the desired width-the desired length of the helical member or the length of the desired number of coils; inserting the pin bodies 16 of connecting pin members 14 into the helical members 1 with the heads 17 of the connecting pin members 14 pushed against the end faces 15 of the helical members 1; and pressing the coils of the helical members 1 to the inserted pin bodies 16 so as to be rigidly fixed thereto. Therefore the number of pin bodies 16 of a connecting pin member 14 may be one or more. Since the connecting pin members 14 prevent the raveling of the helical members 1 at the edges of the band-like object and since the heads 17 of the connecting pin members 14 cover the lateral faces of the band-like object to smooth them, the connecting pin members 14 can obviate the longstanding drawback of the cut end's catching other objects.

Figure 5:
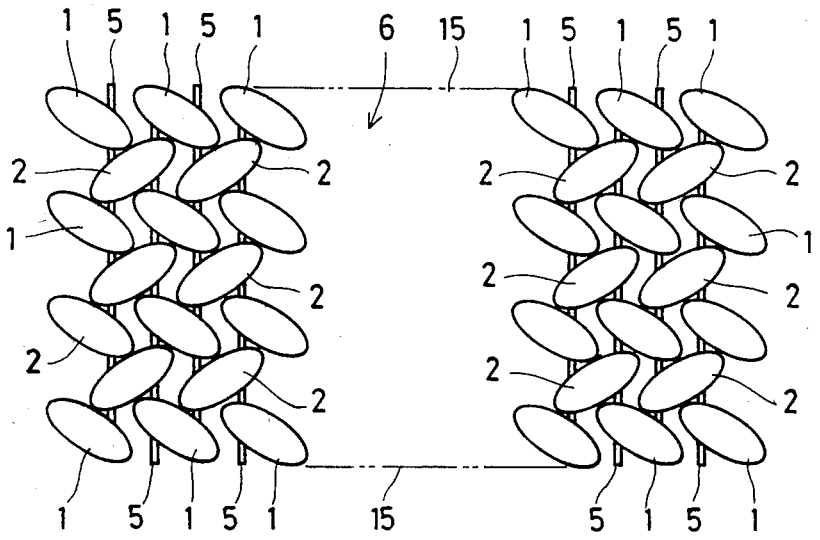
FIG. 5 is a schematic plan view of a conventional mesh band which has a row of parallel, alternate left-handed and right-handed helical members intermeshing shallowly with one another.
Figure 6:
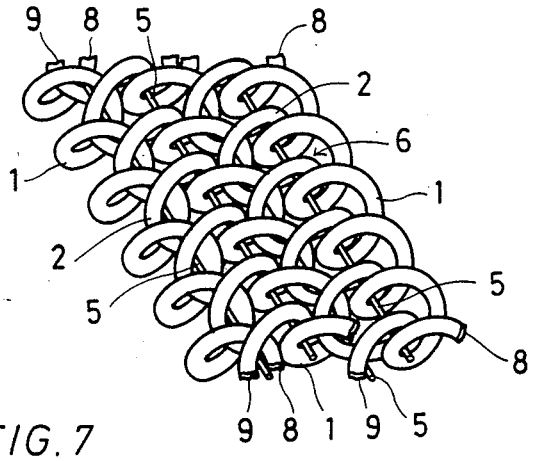
FIG. 6 is a perspective view of the conventional mesh band of FIG. 5.
Figure 7:
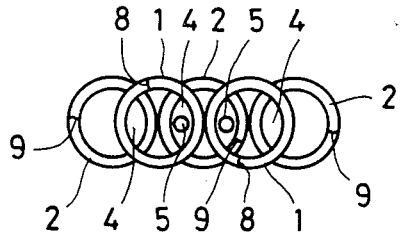
FIG. 7 is a schematic side view of the conventional mesh band of FIG. 5.
Figure 11:
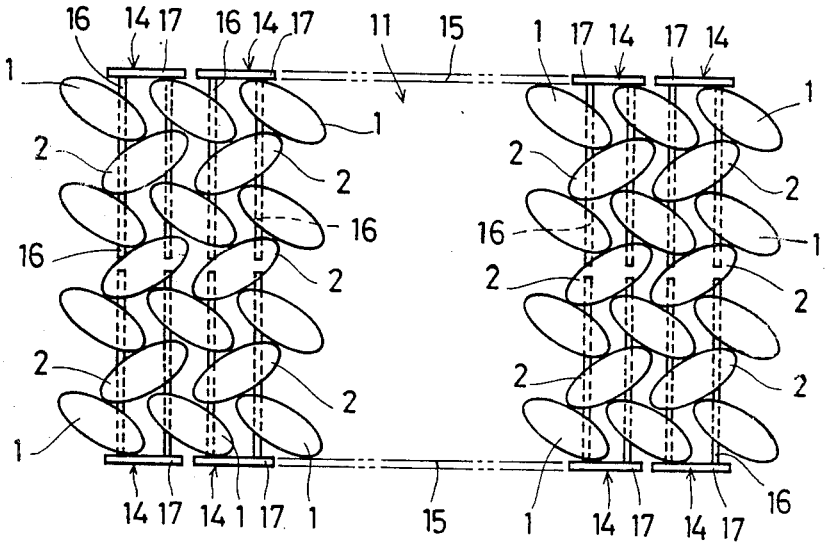
FIG. 11 is a schematic plan view of another embodiment according to the invention which is roughly the same as the conventional mesh band of FIG. 5 in the arrangement of helical members.

Another mesh band 11 embodying the invention may be seen in FIG. 11 to comprise: a row of parallel, alternate left-handed and right-handed helical members 1, 2 engaging shallowly with one another to form engagement portions 4 such as those shown in FIG. 7; and a multiplicity of pairs of connecting pin members 14, each connecting pin member 14 having two pin bodies 16 and a head 17. A pair of diametrically opposed pin bodies 16 are inserted across the length of each of columns of the engagement portions 4 to connect the helical members 1, 2 to one another. This mesh band is what is called a herringbone mesh band and is roughly the same as a conventional mesh band of FIG. 5 in the arrangement of helical members; namely, in the mesh band 11 embodying the invention, each connecting rod 5 of FIG. 5 is replaced by a pair of the diametrically opposed pin bodies 16 which function as a connecting means, and the heads 17 of the connecting pin members 14 cover the cut ends 8, 9 of the left-handed and right-handed helical members 1, 2 situated in the lateral faces 15 of a band-like object or a strip, which fact results in the solution of the longstanding problem of the cut end's catching other objects. The number of the pin bodies 16 of a connecting pin member 14 may be one or two; however, a connecting pin member 14 which has two pin bodies 16 is thought to be more effective in inserting them into the helical member and in manufacturing the connecting pin member. A mesh band more excellent in ornamental design may be provided by imparting an ornamental property to the mesh band 11, for example, by using the helical members and connecting pin members, both of which are different from each other in material, or by putting in colors to or making patterns on the heads 17 of the connecting pin members 14.

Figure 8:
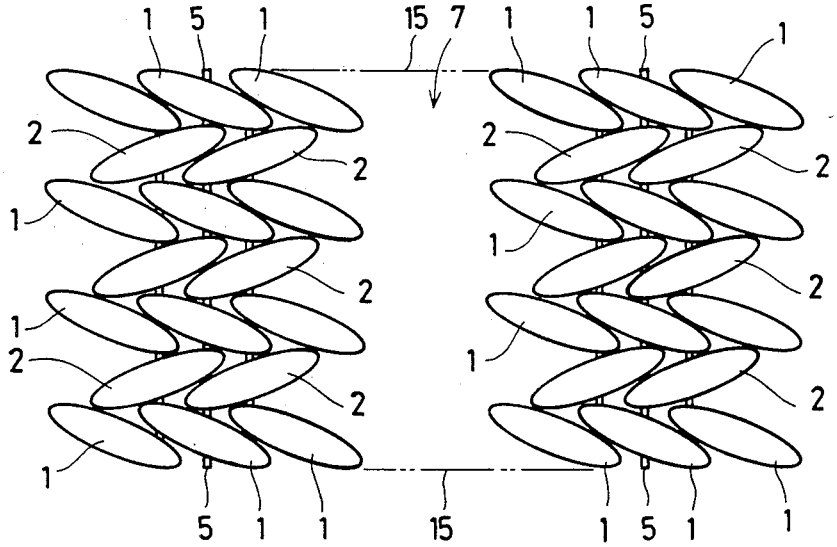
FIG. 8 is a schematic plan view of a conventional mesh band in which three connecting rods are inserted into each helical member.
Figure 12:
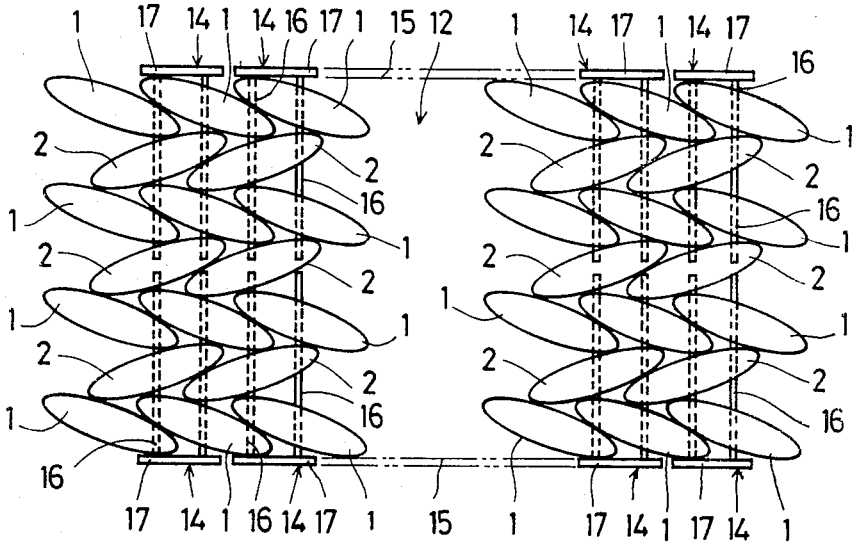
FIG. 12 is a schematic plan view of a further embodiment according to the invention which is roughly the same as the conventional mesh band of FIG. 8 in the arrangement of helical members.

A further mesh band 12 embodying the invention may be seen in FIG. 12 to be what is called a herringbone mesh band of the type in which parallel, alternate left-handed and right-handed helical members 1, 2 intermesh deeply with one another and thereby three pairs of pin bodies 16 are inserted into each of the helical members 1, 2. The number of the pin bodies 16 of a connecting pin member 14 may be one or more, and a combination of a connecting pin member having one pin body and a connecting pin member having plural pin bodies may be used. The mesh band shown in FIG. 12 is roughly the same as a conventional mesh band of FIG. 8 in the arrangement of helical members.

Figure 13:
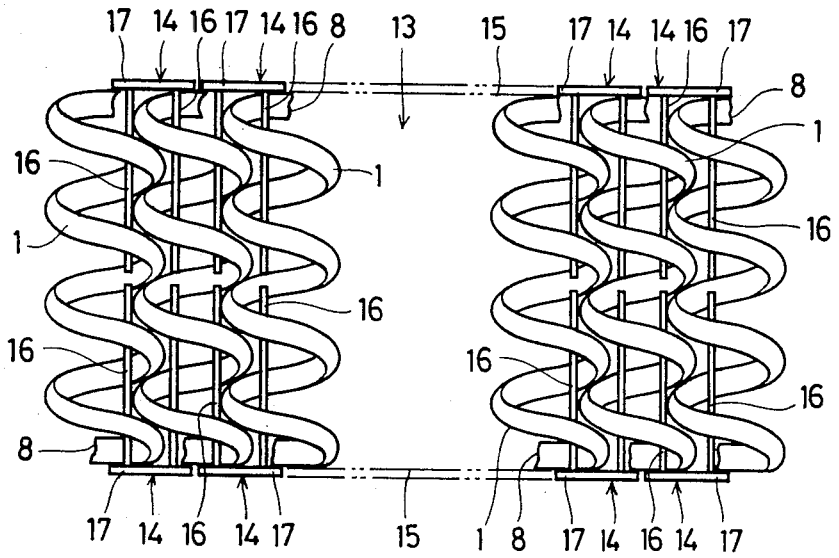
FIG. 13 is a schematic plan view of a still further embodiment according to the invention.

A still further mesh band 13 embodying the invention may be seen in FIG. 13 to comprise: a row of parallel, helical members of the same direction of wind, for example, left-handed helical members intermeshing slightly with one another; and a multiplicity of pairs of connecting pin members 14, each said connecting pin member 14 having two pin bodies 16 and a head 17. The pin bodies 16 of each said pair of the connecting pin member 14 are inserted into two intermeshing helical members 1 in such a way that the connecting pin members of each said pair are diametrically opposed to each other with relation to the longitudinal centerline of the mesh band. The pin bodies thus inserted 16 connect the helical members 1 to one another. The coils of the helical members 1 are rigidly fixed to the inserted pin bodies 16. A mesh band may likewise be constructed by the use of right-handed helical members 2 instead of the left-handed helical members 1.

Although the invention has been described with respect to a few embodiments thereof, it is to be clearly understood by those skilled in the art that the invention is not limited thereto or thereby, but various changes and modifications, or the various combinations and arrangement of parts can be made in the invention without departing from the spirit and scope thereof. Since a problem of the lateral face's catching other objects in a conventional mesh band arises from the cut ends 8 and/or 9 of helical members 1 and/or 2, the mesh bands of higher quality can be supplied to the market by covering the cut ends 8 and/or 9 without impairing the characteristics which such mesh bands should possess. The connecting pin members 14 of the invention eliminate the above-mentioned drawback of catching other objects, irrespective both of the material of which helical members are made and of the shape thereof, and the impartation of ornamentality to the heads 17 of the connecting pin members 14 may enable us to provide a mesh band having a novel ornamental design not obtainable from a conventional one.

Figure 14:
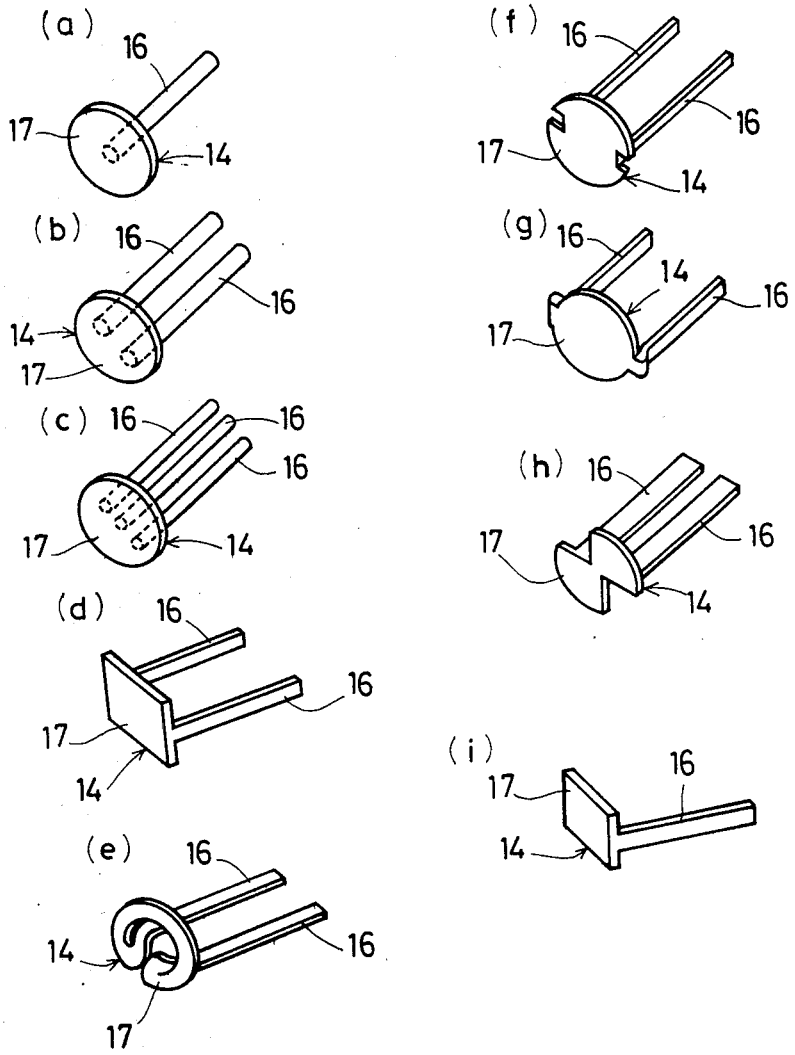
FIG. 14 is the perspective views of various connecting pin members related to the invention.

FIG. 14 shows the connecting pin members 14-*a* through 14-*i* embodying the invention. A connecting pin member 14-*a* has a pin body 16 and is shaped into a thumbtack-like form. The head 17 of the connecting pin member 14-*a* may previously be formed into the same shape as the lateral face of the helical member in a finished state of a mesh band. Connecting pin members 14-*b*, 14-*c* have two and three pin bodies 16 respectively. Like the head 17 of the connecting pin member 14-*a*, the head 17 of each of the connecting pin members 14-*b*, 14-*c* may beforehand be formed into the same shape as the lateral face of the helical member in a finished state of its own mesh band. Each of connecting pin members 14-*d* through 14-*h* has a head 17 and two pin bodies 16, both of which are integrally formed with each other out of one and the same stock. A connecting pin member 14-*i* comprises a head 17 and a pin body 16, both of which are integrally formed with each other out of one and the same stock. The pin body 16 of the connecting pin member 14-*i* is eccentric with respect to the head 17 thereof. The shape of a head 17 is not limited to those shown in FIG. 14, but any shape and size that can cover the cut end 8 or 9 of a helical member 1 or 2 may be employed. The number of pin bodies 16 may be varied as required. In the case of a mesh band of the type having a row of parallel, helical members of the same direction of wind fitted into one another and connecting pin members, each of the pin bodies thereof not only serves to reinforce the connective strength between two mating helical members, but also provides the places to which the coils thereof are rigidly fixed.

In the mesh band of the invention, the cut ends of helical members in the lateral faces of an in-process mesh band are covered with the heads of connecting pin members, which fact has led to the solution of that problem of the lateral face's catching other objects which was incident to a conventional mesh band. Furthermore, either ornamentality such as color, patterns, etc., may be imparted to the heads of helical members, or the respective materials of which a connecting pin member and a helical member are made may be caused to be different from each other in order to create a novel ornamental design, which fact will result in a mesh band which meets diversified needs. In the herringbone mesh band of the invention in which left-handed helical members are arranged alternatively with right-handed ones, connecting pin members, each of which has at least one pin body and a head integral therewith, are substituted for conventional connecting rods having no head. Therefore the need for attaching heads individually to the connecting rods which have been inserted into the helical members so arranged is eliminated, which fact will assure the extremely efficient manufacture of the mesh band.

As having been mentioned above, the mesh band of the invention is an epoch-making one in which, no matter how arranged any helical members are, the cut ends thereof are covered with the heads of connecting pin members, and the coils of the helical members are rigidly fixed to the pin bodies of the connecting pin members, which fact permits the mesh band to fulfill its function proper as a mesh band and to remove all the drawbacks of a conventional mesh band.

What is claimed is:

1. A mesh band comprising a plurality of juxtaposed helical members, each of said helical members having a first end and a second end, said plurality of juxtaposed helical members being disposed such that said first ends define an end face extending longitudinally of the mesh band and said second ends define a second end face extending longitudinally of the mesh band such that said first end face is spaced from said second end face by the length of said helical members, a plurality of first pin members each having a first head and at least one first elongated pin body integrally formed with said first head, said first pin bodies having a longitudinal length not exceeding one half the length of said helical members, said first pin members being disposed along said first end face such that said first pin bodies extend partially into said helical members from said first end face and said first heads are disposed along said first end face to cover said first ends of said helical members, a plurality of second pin members each having a second head and at least one second elongated pin body integrally formed with said second head, said second pin bodies having a longitudinal length not exceeding one half the length of said helical members, said second pin members being disposed along said second end face such that said second pin bodies extend partially into said helical members from said second end face and said second heads are disposed along said second end face to cover said second ends of said helical members, said helical members being rigidly fixed to said first and second pin bodies for connecting said helical members together by means of said first and second pin members to form a unitary mesh band, said first and second heads protectively covering said first and second ends of said helical members respectively so that the mesh band can be safely worn by a user without exposure to said first and second ends of said helical members.

2. A mesh band according to claim 1, wherein said helical members are helically wound in the same direction.

3. A mesh band according to claim 1, wherein some of said helical members are wound in one direction and others of said helical members are wound in a different direction.

4. A mesh band according to claim 1, wherein said helical members are alternately wound in different directions.

5. A mesh band according to claim 1, wherein said helical members are disposed in generally parallel rows.

6. A mesh band according to claim 1, wherein said helical members are disposed such that adjacent helical members mesh with one another.

7. A mesh band according to claim 1, wherein each of said helical members has a longitudinal extending central axis, said heads being disposed generally perpendicular to said axes, said pin bodies being disposed generally parallel to said axes.

8. A mesh band according to claim 1, wherein said heads are generally flat, said pin members extending generally perpendicular to said heads.

9. A mesh band according to claim 1, wherein said first and second pin bodies have terminating inner ends, the terminating ends of said first pin bodies being longitudinally spaced from the terminating ends of said second pin bodies.

10. A mesh band according to claim 1, wherein each of said first and second pin members has one pin body.

11. A mesh band according to claim 1, wherein each of said first and second pin members has two pin bodies.

12. A mesh band according to claim 1, wherein each of said first and second pin members has three pin bodies.

13. A mesh band according to claim 1, wherein each of said first and second heads has a circular configuration.

14. A mesh band according to claim 1, wherein each of said first and second heads has a rectangular configuration.

15. A mesh band according to claim 1, wherein each of said first and second heads comprises a generally flat plate member completely covering said first and second ends of said helical members.

16. A mesh band according to claim 1, wherein said first pin bodies have longitudinal axes coincident with the longitudinal axes of said second pin bodies.

* * * * *